US009815614B2

(12) United States Patent
Griffin et al.

(10) Patent No.: US 9,815,614 B2
(45) Date of Patent: Nov. 14, 2017

(54) KNITTING NEEDLE STORAGE DEVICE

(71) Applicant: Handwork Hardware, LLC, Minneapolis, MN (US)

(72) Inventors: Cornelia Caulfield Griffin, Minneapolis, MN (US); Judith Arden VanCleve, Minneapolis, MN (US)

(73) Assignee: Handwork Hardware LLC, Minneapolis, MN (US)

( * ) Notice: Subject to any disclaimer, the term of this patent is extended or adjusted under 35 U.S.C. 154(b) by 1 day.

(21) Appl. No.: 14/672,653

(22) Filed: Mar. 30, 2015

(65) Prior Publication Data

US 2015/0284891 A1 Oct. 8, 2015

Related U.S. Application Data

(60) Provisional application No. 61/995,070, filed on Apr. 3, 2014.

(51) Int. Cl.

| | |
|---|---|
| ***D05B 91/12*** | (2006.01) |
| ***B65D 43/02*** | (2006.01) |
| ***B65B 7/28*** | (2006.01) |
| ***B65D 51/26*** | (2006.01) |
| ***B65B 5/08*** | (2006.01) |
| ***B65B 39/00*** | (2006.01) |
| ***B65D 25/04*** | (2006.01) |
| ***B65D 25/10*** | (2006.01) |
| ***B65D 85/24*** | (2006.01) |
| ***D04B 3/00*** | (2006.01) |
| ***D04B 37/02*** | (2006.01) |
| ***B65D 83/02*** | (2006.01) |

(52) U.S. Cl.

CPC ..... *B65D 85/24* (2013.01); *B65D 83/02* (2013.01); *D04B 3/00* (2013.01); *D04B 37/02* (2013.01); *B65D 2203/00* (2013.01)

(58) Field of Classification Search

CPC ..... B65D 83/02; B65D 85/24; B65D 85/08; B65D 85/10; B65D 85/1009; B65D 85/12; B65D 85/14; B65D 85/20; B65D 85/22; B65D 85/26; B65D 85/28; B65D 2203/00; A61B 17/06114; A61M 5/002

USPC ..... 206/380, 382, 804; 220/8

See application file for complete search history.

(56) References Cited

U.S. PATENT DOCUMENTS

| | | | | |
|---|---|---|---|---|
| 162,989 A | | 5/1875 | Yeomans | |
| 2,252,381 A | * | 8/1941 | Ladd | A24F 15/06 206/804 |
| 2,585,476 A | | 2/1952 | Lerner et al. | |

(Continued)

FOREIGN PATENT DOCUMENTS

WO WO-2008017885 2/2008

*Primary Examiner* — Andrew Perreault

(74) *Attorney, Agent, or Firm* — Schwegman Lundberg & Woessner, P.A.

(57) ABSTRACT

A storage device for holding at least one double ended knitting needle where the storage device includes a needle sorter including a first end and a second end with a gauge cap at the first end of the needle sorter, a bottom cap at the second end of the needle sorter, and a storage tube including a top end portion and a bottom end portion, wherein the needle sorter is located within the storage tube to provide a plurality of needle compartments within the storage tube, and wherein the needle sorter slides with respect to the storage tube to allow user removal of needles from the needle compartments.

20 Claims, 6 Drawing Sheets

(56) References Cited

U.S. PATENT DOCUMENTS

| | | | | |
|---|---|---|---|---|
| 2,628,711 | A | 2/1953 | Flannery | |
| 2,935,186 | A * | 5/1960 | Clark | A61F 17/00 206/226 |
| 3,052,391 | A | 9/1962 | Tracy | |
| 3,063,551 | A | 11/1962 | Russell | |
| 3,084,788 | A | 4/1963 | Ford | |
| 3,326,049 | A * | 6/1967 | Eley | E21B 25/00 73/429 |
| 3,381,875 | A | 5/1968 | Tunick | |
| 6,361,524 | B1 * | 3/2002 | Odell | A61M 5/3129 604/181 |
| 6,412,637 | B1 | 7/2002 | Saunders et al. | |
| 7,469,584 | B1 * | 12/2008 | Subnick | G01F 19/00 116/227 |

* cited by examiner

KNITTING NEEDLE STORAGE DEVICE

CLAIM OF PRIORITY

This patent application claims the benefit of priority of Cornelia Caulfield Griffin and Judith Arden Van Cleve U.S. Provisional Patent Application Ser. No. 61/995,070, entitled "Double Pointed Knitting Needle Sorter and Gauge," filed on Apr. 3, 2014, which is hereby incorporated by reference herein in its entirety.

BACKGROUND

Hand knitting is a method by which thread or yarn can be manually manipulated to create cloth or other useful items. Knitting needles are the implements used by knitters to practice their craft and are manufactured in a variety of diameters or gauges. Double ended knitting needles, or those needles with points on both ends, are particularly useful tools, but can present storage challenges such as with regards to convenience and safety concerns (such as needle pokes when selecting needles).

A variety of containers exist for the storage of knitting needles. For example, U.S. Pat. No. 2,585,476 mentions a portable container for holding knitting needles in pockets at the peripheral portion of the container.

U.S. Pat. No. 3,084,788 mentions a knitting needle holder comprising a cylindrical container having a bottom and having a transparent plastic wall, a pair of identical plates having apertures of different sizes therein.

U.S. Pat. No. 3,052,391 mentions a knitting accessory and container having a top wall provided with a plurality of vertical hole-defining means for removably receiving and supporting a plurality of knitting needles.

OVERVIEW

The present inventors have recognized, among other things, that there is a need in the art for a double ended knitting needle storage container that will allow a user the ability to automatically sort needles of different gauges into appropriate groups and provide convenient access to those groups.

This document describes, among other things, a storage device such as for holding at least one double ended knitting needle. The storage device can include a needle sorter. The needle sorter can include a first end and a second end. A gauge cap can be located at the first end of the needle sorter. A bottom cap can be located at the second end of the needle sorter. A storage tube can be provided. The storage tube can include a top end portion and a bottom end portion. The needle sorter can be located within the storage tube, such as to provide a plurality of needle compartments within the storage tube. The needle sorter can slide with respect to the storage tube, such as to allow user removal of one or more needles from the respective needle compartments.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
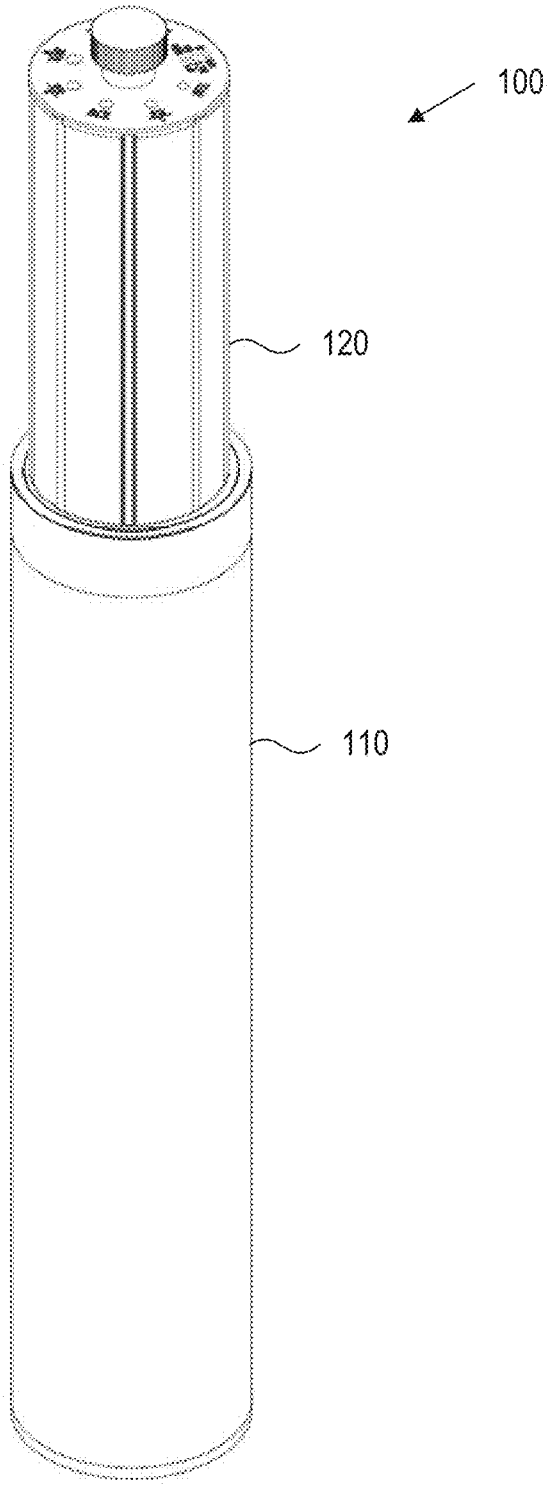
FIG. 1 shows an example of a needle storage device.

FIG. 1 shows an example of a storage device 100. In an example, the storage device 100 can include a needle sorter 120 that can be inserted into and located within a storage tube 110.

Figure 2A:
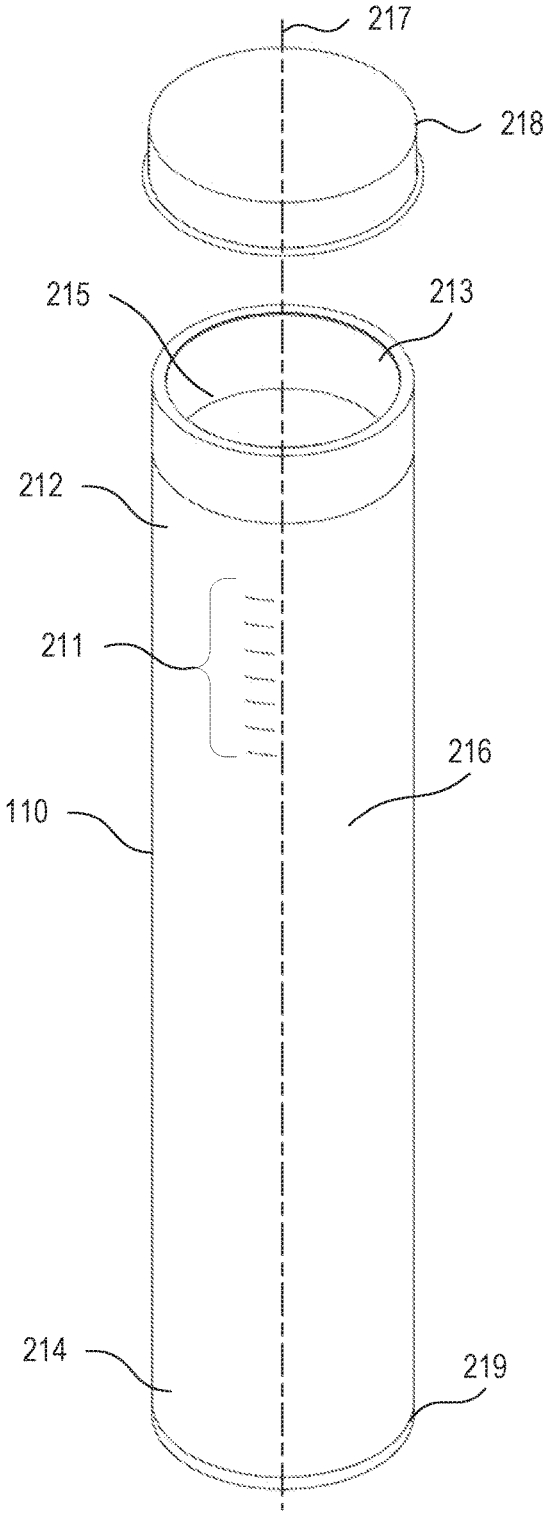
FIG. 2A shows an example of a storage tube.

FIG. 2A shows an example of a storage tube 110. In an example, the storage tube 110 can include a top end portion 212, such as with an inner lip 213, a bottom end portion 214, an inner surface 215, an outer surface 216, and can define a longitudinal central axis 217. In an example, the storage tube 110 can include a tube to which a user-removable lid 218 can be removably attached to the top end portion 212. The storage tube 110 can include a base 219, or the base 219 can be affixed to the bottom end portion 214 of the storage tube 110. For example, the lid 218 can be removably attached by providing a threaded interface, a friction interface, or other similar connection interface, or any combination thereof.

In an example, the storage tube 110 can include a length gauge 211, such as can be used to provide a measuring device. In an example, the length gauge 211 can be included in or can be affixed to the inner surface 215 or the outer surface 216 of the storage tube 110. In an example, the length gauge 211 can be formed into the inner surface 215 or the outer surface 216 of the storage tube 110, such as by providing embossed indicia (e.g., raised or sunken). In an example, the indicia can include letters, numbers, marks, symbols, or any combination thereof. In an example, the length gauge 211 can be formed as a covering and applied to the inner surface 215 or the outer surface 216 of the storage tube 110. Examples of a covering can include a decal, a sticker, or other similar surface covering.

The storage tube 110 can include any cross-sectional shape without altering the effect of the storage tube 110, such as a square, a triangular, an oval, or any bilaterally or non-bilaterally symmetric or other shape. In an example, the storage container 110 can include a generally circular cross-sectional shape. The storage tube 110 can be made from any material without altering the effect of the storage tube 110, such as a paper, a cardboard, a metal, or a polymer material, or any combination thereof, such as with different durometer ratings. In an example, the material can include any opacity such as transparent, translucent, or opaque opacities, or any combination thereof.

Figure 2B:
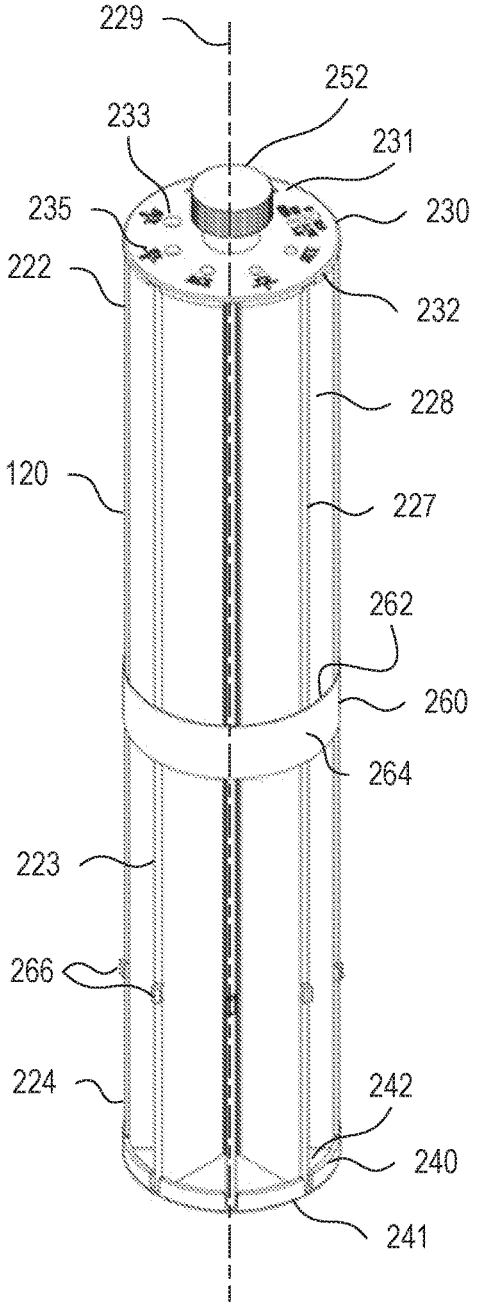
FIG. 2B shows an example of a needle sorter.

FIG. 2B shows an example of a needle sorter 120. In an example, the needle sorter 120 can include a first end 222 and a second end 224. The needle sorter 120 can define a longitudinal central axis 229. A gauge cap 230 can be included at or affixed to the first end 222 of the needle sorter 120. A bottom cap 240 can be included at or affixed to the second end 224 of the needle sorter 120. The needle sorter 120 can include a contact interface. The needle sorter 120 can include or be coupled to a retaining stop 260, such as can be in contact with the needle sorter 120.

The needle sorter 120 can be used to separate collections of objects (e.g., knitting needles) such as can share one or more common characteristics (e.g., size, such as diameter). In an example, a common characteristic can be the gauge of a knitting needle, such as a double ended knitting needle. The needle sorter 120 can define two or more compartments such as needle spaces 228. The needle spaces 228 can include any cross-sectional shape without altering the effect of the needle sorter 120 including such as a square, a triangular, a sector (e.g., pie-shaped wedge) or any bilaterally or non-bilaterally symmetric or other shape.

In an example, the needle sorter 120 can include a plurality (e.g., 2, 3, 4, 5, 6, 7, 8, 9, 10, or other number) of radial fins 227. In an example, the radial fins 227 can include any cross-sectional shape without altering the effect of the radial fins including such as a concave, a convex, one or more curves, one or more angles, or any other shape.

In an example, the radial fins 227 can be joined together at, and can extend from, the central axis 229 with outward-facing surfaces 223. In an example, the radial fins 227 can be joined together at any surface of another radial fin 227, so that the joint so formed can be generally parallel with the central axis 229.

In an example, the outward-facing surfaces 223 of the radial fins can abut and slide against the inner surface 215 of the storage tube 110. Together with the inner surface 215 of the storage tube 110, the radial fins 227 can define the compartments such as the needle spaces 228 of the needle sorter 120.

In an example, the needle sorter 120 can include a shape that can be compatible with the cross-section of the storage tube 110, such as to allow the needle holder 120 to be inserted into and located within the storage tube 110. The needle sorter 120 can be made from any material without altering the effect of the needle sorter 120, such as one or more of a paper, a cardboard, a metal, or a polymer material, or any combination of such materials, such as with different durometer ratings. In an example, the material can include any opacity such as transparent, translucent, or opaque opacities, or any combination thereof.

The gauge cap 230 can be used to separate collections of objects (e.g., knitting needles) that share one or more common characteristics (e.g., size, such as diameter), such as into a particular individual compartment such as a needle space 228. The gauge cap 230 can include a top surface 231, a bottom surface 232 such as can be generally opposite and parallel to the top surface 231, and one or more gauge holes 233 such as of a specified diameter and such as can extend through the gauge cap 230 such as from the top surface 231 to the bottom surface 232. In an example, the bottom surface 232 of the gauge cap 230 can be bonded to or otherwise affixed to a first end 222 of the needle sorter 120 and can be configured to receive objects (e.g., knitting needles) with at least one common characteristic (e.g., size, such as diameter) and to collect those objects in a compartment such as a needle space 228. In an example, each gauge hole 233 can be differently sized and can be oriented with respect to the needle sorter 120 such as to communicate with a one and only one needle space 228 or like compartment.

The gauge cap 230 can include label indicia 235 to indicate the gauge of needle that can be inserted through the corresponding gauge hole 233. The label indicia 235 can include letters, numbers, symbols, or any combination thereof. The label indicia 235 can be included in or can be affixed to the top surface 231 of the gauge cap 230. The label indicia 235 can be formed into the top surface 231 of the gauge cap 230, such as by providing embossed indicia (e.g., raised or sunken). The label indicia 235 can be formed as a covering and applied to the top surface 231 of the gauge cap 230. Examples of a covering can include a decal, a sticker, or other similar surface covering.

In an example, the gauge cap 230 can be located at or removably attached to the top end portion 212 of the storage tube 110, e.g., instead of being attached to the first end 222 of the needle sorter 120. In an example, the bottom surface 232 of the gauge cap 230 can be affixed to a first end 222 of the needle sorter 120 and further, the bottom surface 232 or other portion of the gauge cap 230 can be located at or removably attached to the top end portion 212 of the storage tube 110. In an example, such removable attachment can include using a threaded interface, a friction interface, or other similar connection interface or any combination thereof. In an example, the gauge cap 230 and the lid 218 can be combined into a single component, such as with the gauge holes 233 formed in the lid 218, and the lid 218 removably attached to the storage tube 110.

The gauge cap 230 can include any cross-sectional shape without altering the effect of the gauge cap 230 such as a round, a square, a triangular, or any bilaterally or non-bilaterally symmetric or other shape. In an example, the gauge cap 230 can include a cross-sectional shape compatible with the cross-section of the storage tube 110 such as to allow the needle holder 120 to be inserted into or located within the storage tube 110. The gauge cap 230 can be made from any material without altering the effect of the gauge cap 230 such as a paper, a cardboard, a metal, or a polymer material, or any combination thereof, such as with different durometer ratings.

The bottom cap 240 can be used to retain double ended or other knitting needles or other collections of objects that share one or more common characteristics in a respective compartment such as a needle space 228, such as while the needle sorter 120 is being withdrawn out of the storage tube 110. The bottom cap 240 can include a bottom surface 241 and a top surface 242 that can be generally opposite and parallel to the bottom surface 241. In an example, the top surface 241 of the bottom cap 240 can be bonded to or otherwise affixed to the second end 224 of the needle sorter 120, such as to retain knitting needles or other desired objects within a compartment such as a needle space 228. The bottom cap 240 can include any shape without altering the effect of the bottom cap 240 such as a round, square, triangular, or any bilaterally or non-bilaterally symmetric or other shape. In an example, the bottom cap 240 can include a shape that can be compatible with the cross-section of the storage tube 110 such as to allow the needle holder 120 to be inserted into or located within the storage tube 110. The bottom cap 240 can be made from any material without altering the effect of the bottom cap 240 such as a paper, a cardboard, a metal, or a polymer material, or any combination thereof, such as with different durometer ratings.

The contact interface can be engaged by a user such as to displace the needle sorter 120 with respect to the storage tube 110. In an example, the contact interface can include any surface of the needle sorter 120. In an example, the contact interface can include any surface contiguous with the needle sorter 120. In an example, the contact interface can include a knob 252 such as can be attached to the top surface 231 of the gauge cap 230. The knob 252 can be configured to allow grasping by a user such as to move the needle sorter 120 such as relative to the storage tube 110. In an example, the knob 252 can be or include a protuberance of any desired size and shape, such as extending from the top surface 231 of the gauge cap 230, optionally sized to fit within and beneath the lid 218 when the needle sorter 120 is fully inserted into the storage tube 110 and the lid 218 is secured to the top end portion 212 of the storage tube 110.

In an example, the contact interface can include the bottom surface 241 of the bottom cap 240 being accessible through an opening in or at the bottom end portion 214 of the storage tube, for example, extending from the outer surface 216 to the inner surface 215. In an example, a user can insert a finger or a tool through the opening in the bottom end portion 214, such as to engage the bottom surface 241 of the bottom cap 240, such as to apply a force such as to move the needle sorter 120 with respect to the storage tube 110.

The retaining stop 260 can be used to limit movement of the needle sorter 120 with respect to the storage tube 110. In an example, the retaining stop 260 can be or include an elastic band such as with an inner surface 262 that can be in intimate contact with the needle sorter 120 and an outer surface 264 that can interact with the storage tube 110. In an example, an inner lip 213 can be formed in the top end portion 212 on the inner surface 215 of the storage tube 110 so that engagement or other interaction of the retaining stop 260 and the inner lip 213 can inhibit or prevent further motion of the needle sorter 120 relative to the storage tube 110 when the needle sorter 120 is being withdrawn from the storage tube 110. In an example, the inner lip 213 can be integrally formed with or attached to the top end portion 212 of the storage tube 110. The inner diameter of the inner lip 213 can be smaller than the inner diameter of the top end portion 212 at locations other than at the inner lip 213. In an example, the elastic band or other retaining stop 260 can be adjusted to a desired one of different locations along the sorter central axis 229 of the needle sorter 120.

The retaining stop 260 can have any shape without altering the effect of the retaining stop 260 such as a round, a square, a triangular, or any or other shape. In an example, the retaining stop 260 can have a shape that can fit against or otherwise be compatible with the cross-section of the storage tube 110 such as to allow the needle holder 120 to be inserted into and located within the storage tube 110. In an example, the retaining stop 260 can assume the shape of a periphery of the cross section of the needle sorter 120. The retaining stop 260 can be made from any material without altering the effect of the retaining stop 260 such as a polymer material with a desired durometer rating and a desired spring rate.

In an example, the retaining stop 260 can include one or more protuberances 266, such as can be attached to one or more outward-facing surfaces 223 of the radial fins 227 of the needle sorter 120, such as can interact with the storage tube 110. The one or more protuberances 266 can assume any shape without altering the effect of the retaining stop 260 such as a round, a square, a triangular, or any other shape. The one or more protuberances 266 can be made from any material without altering the effect of the retaining stop 260 such as a polymer material with a desired durometer rating and a desired spring rate. For example, the retaining stop 260 can include one or more tapered bumps such as shown in FIG. 2B can be integrally connected to one or more outward-facing surfaces 223 of the radial fins 227, such as in which one or more of the tapered bumps can rub against, interfere with, frictionally interact or otherwise interact with the storage tube 110, such as to limit movement of the needle sorter 120 with respect to the storage tube 110.

In an example, the retaining stop 260 can include an elastic component such as can connect the needle sorter 120 to the storage tube 110 such as to limit movement of the needle sorter 120 with respect to the storage tube 110. In an example, the elastic component can include a structure or material that can induce a restoring force between two objects. Examples of elastic components can include, but are not limited to, coil springs, flat springs, volute springs, or rubber components. For example, the retaining stop 260 can include a flat coil spring, such as with a first end attached to the bottom surface 241 of the bottom cap 240 and a second end attached to the bottom end portion 214 of the storage tube 110.

In an example, the retaining stop 260 can be a guide that can be used to control and limit movement of the needle sorter 120 with respect to the storage tube 110. In an example, the guide can be located between the needle sorter 120 and the storage tube 110.

Figure 3A:
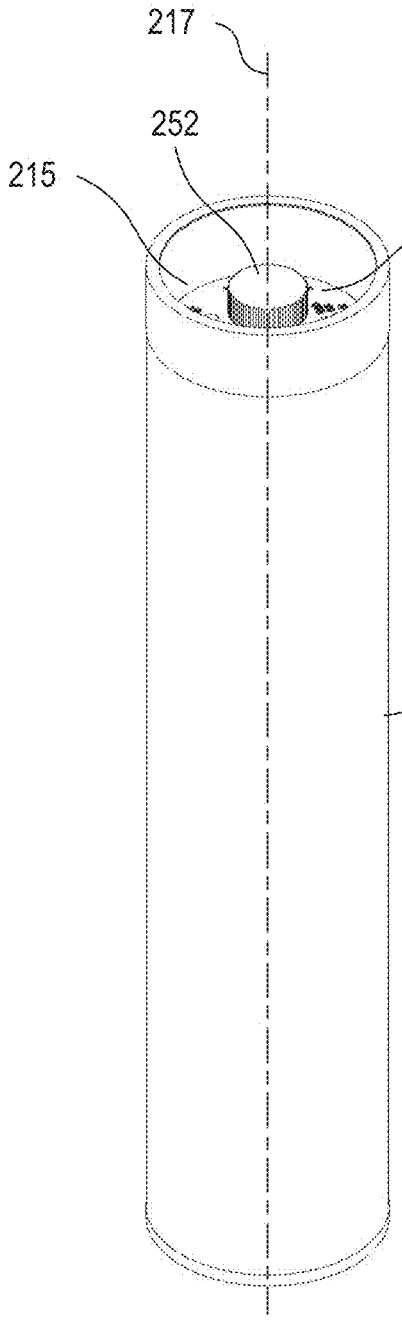
FIGS. 3A and 3B show examples in which the needle sorter can be located within the storage tube.
Figure 3B:
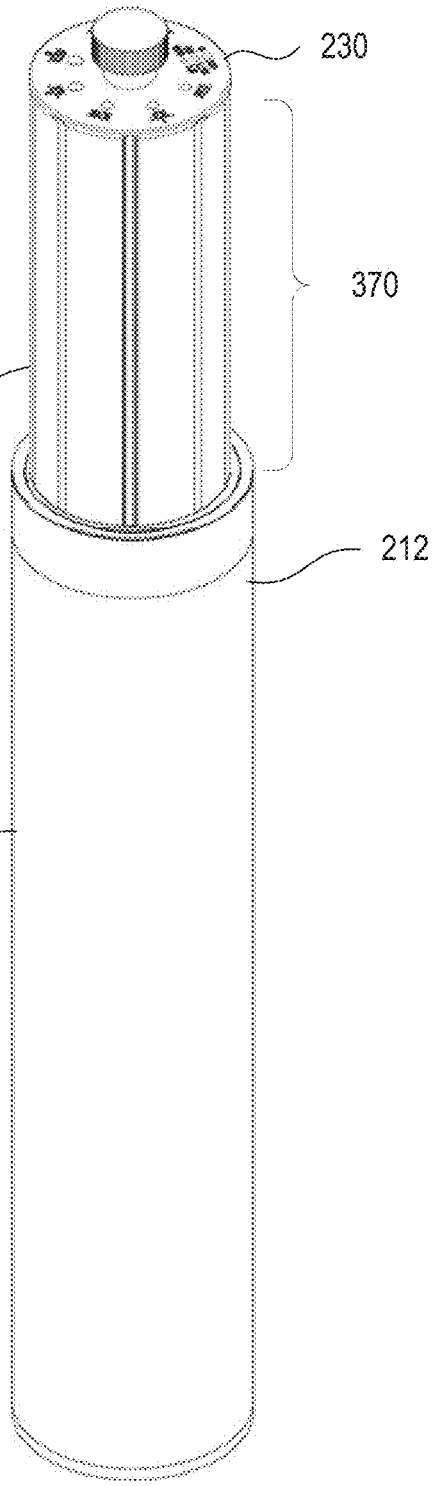

FIGS. 3A and 3B show examples in which the needle sorter 120 can be inserted into and located within the storage tube 110. FIG. 3A shows the needle sorter 120 in a first position in which the needle sorter 120 can be completely located within the storage tube 110. FIG. 3B shows the needle sorter 120 in a second position, in which a portion of the needle sorter 120 can protrude above the top end 212 of the storage tube 110.

One or more guides can be located between the needle sorter 120 and the storage tube 110. In an example, the one or more guides can create a sliding interface such as to control and limit movement between the needle sorter 120 and the storage tube 110. In an example, a guide can include the combination of a protuberance 266, such as a bump or a protrusion as shown in FIG. 2B, and a recess 268, such as a narrow aperture or slot as shown in FIG. 4A, FIG. 4B, and FIG. 4C, into which the protuberance 266 can be inserted to interact with or otherwise slide in the recess 268.

In an example, the protuberance can be attached to or integrally formed with the storage tube 110 or the needle sorter 120. For example, the protuberance can include a knob, a ridge, an extension of one or more radial fins 227, or any other protrusion. In an example, the protuberance can extend from the inner wall 215 of the storage tube 110 generally towards the central axis 217 of the storage tube 110. In an example, the ridge can extend partially or completely between the top end portion 212 and the bottom end portion 214 of the storage tube 110. For example, the protuberance can be a ridge that can be attached to or integrally formed with the inner surface 215 of the storage tube 110 in which the ridge can extend in a direction, such as a generally linear or helically-shaped path, between the top end portion 212 and the bottom end portion 214. In an example, the protuberance can extend from the outward facing surface 223 of the needle sorter 120 in a direction generally away from the central axis 217.

In an example, the recess can be integrally formed with or attached to the storage tube 110 or the needle sorter 120. For example, the recess can include a slot formed into the wall of the storage tube 110 such that the slot can extend through the inner surface 215 of the storage tube 110 and can terminate within the wall of the storage tube 110 or extend through the outer surface 216. In an example, the path of the recess can extend partially or completely between the top end portion 212 and the bottom end portion 214 of the storage tube 110. In an example, the path of the recess located on the inner wall 215 of the storage tube 110 can include any shape such as a linear path, a helical path, a step-wise continuous path (e.g., a piecewise function), or any other shape path.

Figure 4A:
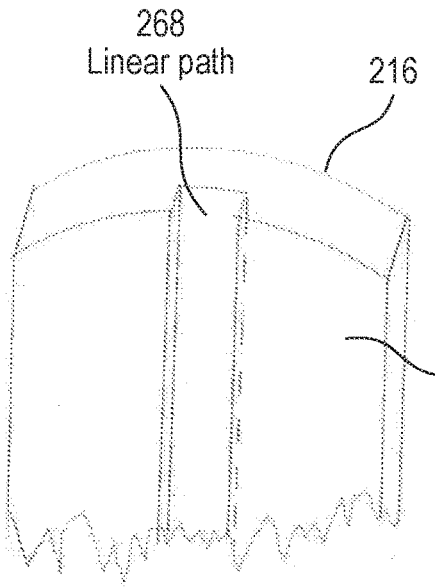
FIG. 4A shows an isometric view of an example linear path in a portion of the wall of the storage tube.
Figure 4B:
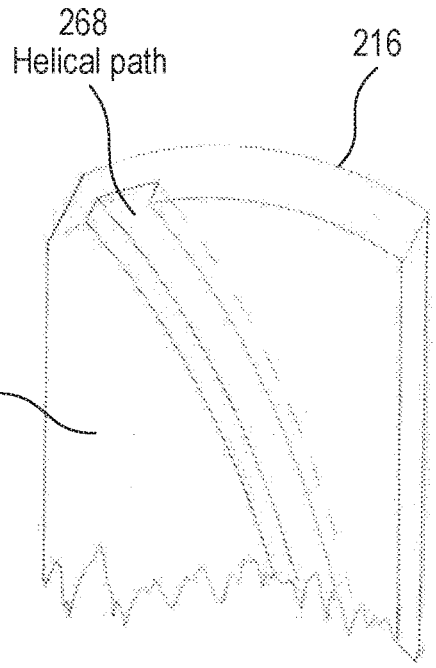
FIG. 4B shows an isometric view of an example helical path in a portion of the wall of the storage tube.
Figure 4C:
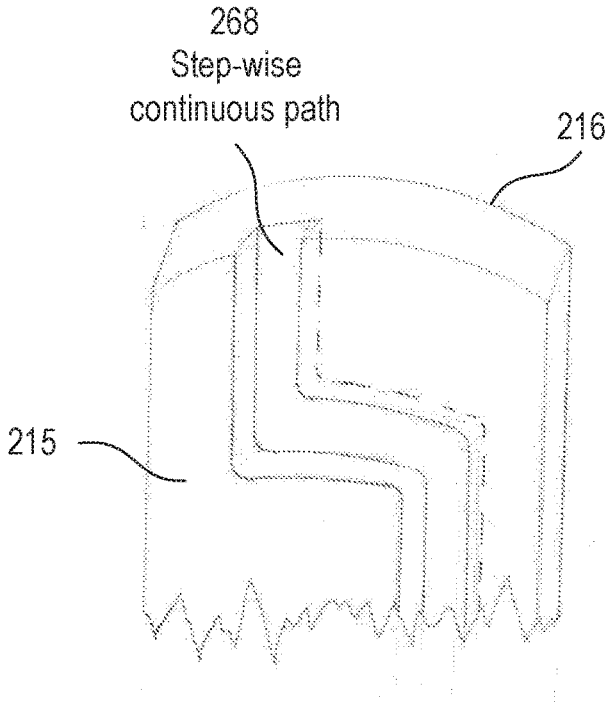
FIG. 4C shows an isometric view of an example step-wise continuous path in a portion of the wall of the storage tube.

FIG. 4A shows an isometric view of an example recess 268 with a linear path in a portion of the wall of the storage tube 110. FIG. 4B shows an isometric view of an example recess 268 with a helical path in a portion of the wall of the storage tube 110. FIG. 4C shows an isometric view of an example recess 268 with a step-wise continuous path in a portion of the wall of 10 the storage tube 110.

In an example, the recess can be formed by an arrangement of protuberances. For example, a recess can be formed by two ridges attached to or integrally formed with the inner surface 215 of the storage tube 110 such that the ridges can be separated by a space sufficient to retain a protuberance, such as a knob, between them and such that the ridges can extend generally parallel to one another. For example, the recess can be formed by two knobs attached to or integrally formed with the inner surface 215 of the storage tube 110 such that the knobs can be separated by a space sufficient to retain a protuberance, such as a ridge, between them.

In an example, the recess can include one or more notches in the needle sorter 120. For example, the recess can include a notch in the periphery of the gauge cap 230, in the periphery of the bottom cap 240, or a combination of notches in the gauge cap 230 and the bottom cap 240.

In an example, the guide can include a protuberance located on the needle sorter 120 and a recess located on the storage tube 110 such that the protuberance can be located in the recess and the protuberance can interact with or otherwise slide in the recess. For example, the guide can include A) a knob, located on the outward facing surface 223 of one or more radial fins 227, and B) a slot, that can be integrally formed into the wall of the storage tube 110 such that the knob can be inserted into the slot and slide along the slot. In an example, the path of the slot that can extend along the inner surface 215 of the storage tube 110 can include any shape, such as a linear path or a helical path, so as to create a respective linear or twisting movement of the needle sorter 120 with respect to the storage tube 110 as the needle sorter 120 slides parallel to the central axis 217. In an example, the path of the slot can include a step-wise continuous path arranged such that as the needle sorter slides parallel to the central axis 217, a segment of the path of the slot can lie in a plane that is generally perpendicular to the central axis 217 so that on reaching the generally perpendicular segment, the needle sorter 120 can remain in a stationary configuration with respect to the storage tube without further user interaction. Such a step-wise continuous path can allow a user to have access to feathered needles without having to hold the needle sorter 120. For example, the step-wise continuous path can include a stair-shaped path which can include at least a first and second segments that are generally perpendicular with respect to one another, such that the first segment can be generally parallel to the central axis 217 and the second segment can be generally perpendicular with respect to the first segment.

In an example, the guide can include A) an extension of one or more radial fins 217 of the needle sorter 120, and B) two ridges attached to or integrally formed with the inner surface 215 of the storage tube 110 such that the ridges can define a slot such that the extension can be located between two ridges so as to create a linear movement of the needle sorter 120 with respect to the storage tube 110 as the needle sorter 120 slides parallel to the central axis 217.

In an example, the guide can include a protuberance located on the storage tube 110 and a recess located on the needle sorter 120 such that the protuberance can be located in the recess and the protuberance can interact with or otherwise slide in the recess. For example, the guide can be A) a ridge, that can be located on the inner surface 215 of the storage tube 110 and can form a helix-shaped path between the top end portion 212 and bottom end portion 214 of the storage tube 110, and B) a slot, that can be a notch that can be located in the periphery of the bottom cap 240 such that the ridge can be located in the slot and can slide in the slot so as to create a twisting movement of the needle sorter 120 with respect to the storage tube 110 as the needle sorter 120 slides parallel to the central axis 217.

Movement of the needle sorter 120 from the first position to the second position can create an access gap 370 that can define a distance between the gauge cap 330 and the top end portion 212 of the storage tube 110. In an example, the elastic band or other retaining stop 260 can interfere or otherwise interact with the top end portion 212 or the inner lip 213 of the storage tube 110, such as to restrict motion of the needle sorter 120 with respect to the storage tube 110 and can define a second position. In an example, the elastic band or other retaining stop 260 can be adjusted such as to a desired one of different locations along the central axis 229 of the needle sorter 120 and can define a second position.

The needle sorter 120 can be moved relative to the storage tube 110. In an example, the outer periphery of the needle sorter 120 can abut or be in close proximity to the inner surface 215 of the storage tube 110. As a user grasps the knob 252 and moves the needle sorter 120 relative to the storage tube 110, the needle sorter 120 can slide along the inner surface 215 parallel to the central axis 217 of the storage tube 110.

Figure 5:
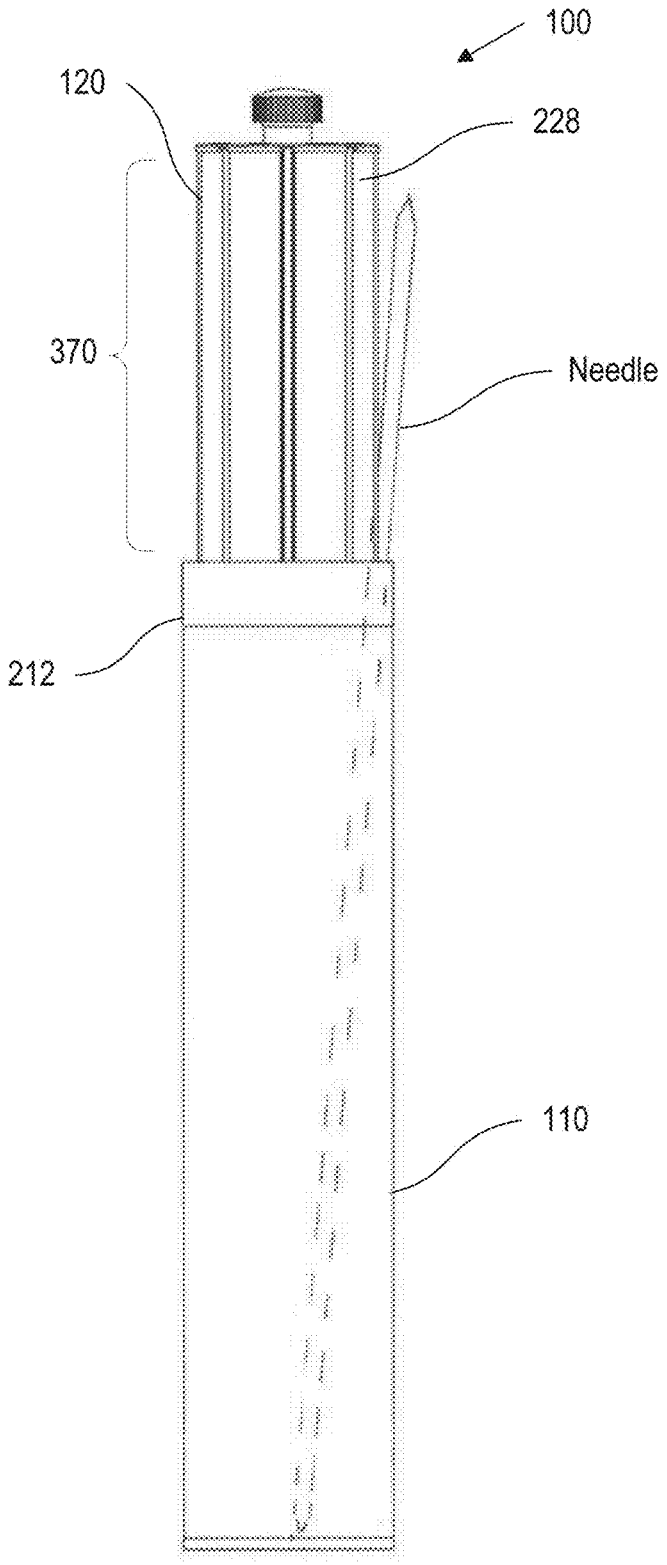
FIG. 5 shows a side view of the storage device in an example.

FIG. 5 shows a side view of the storage device 100 in an example. As the needle sorter 120 moves from a first position to a second position relative to the storage tube 110, an access gap 370 can be created. In an example, the access gap 370 can allow a portion of any needles stored within the needle spaces 228 to extend beyond the top of the top end portion 212 of the needle storage tube 110. This can help permit or cause the stored needles to 'feather' or otherwise fall against the top end portion 212 of the storage tube 110, such as shown in FIG. 4. In an example, with the needles resting against the top portion 212 of the storage tube 110, the user can conveniently select or extract a particular needle such as by grasping one of the needles so feathered.

Figure 6:
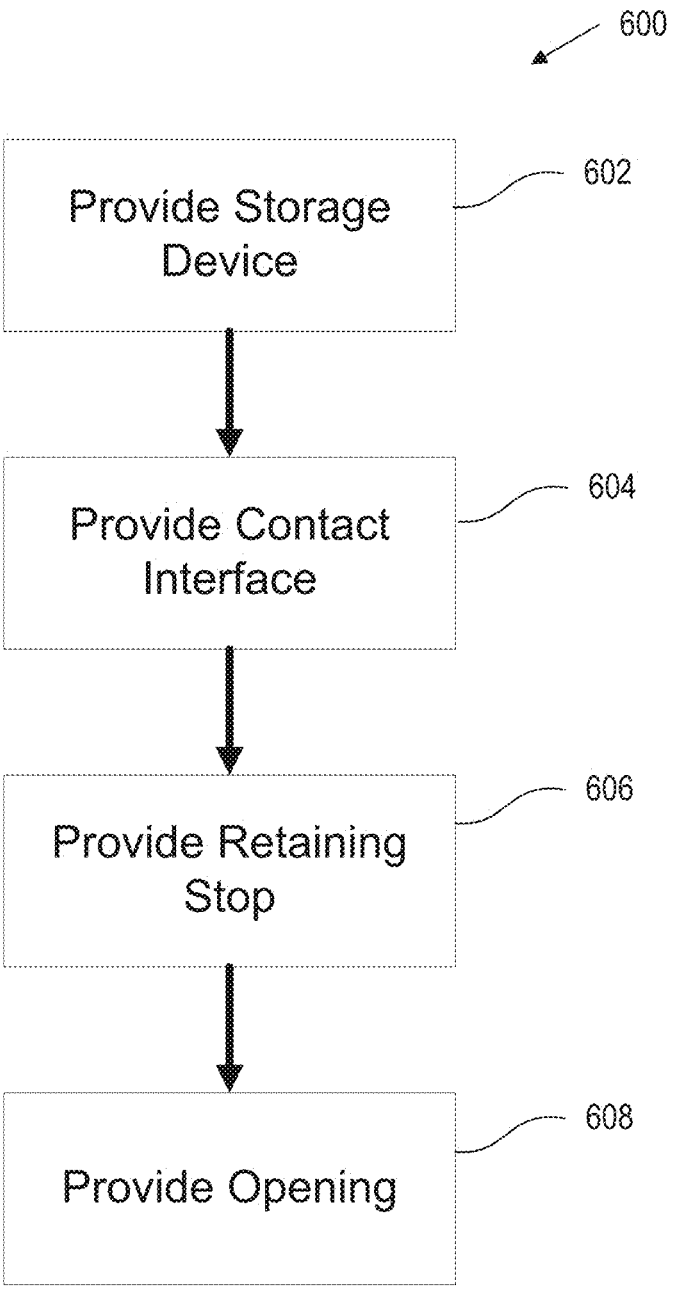
FIG. 6 is a flowchart of an example of a method for selecting double ended knitting needles from a storage device.

FIG. 6 is a flowchart of an example of a method 600 such as for selecting double ended knitting needles or other stored objects from a storage device 100. At 602, a storage device 100 can be provided. In an example, the storage device 100 can include a storage tube 110 and a needle sorter 120 that can be at least partially located within the storage tube 120 such as with the needle sorter 120 being configured to move relative to the storage tube 110.

At 604, a contact interface 250 can be provided. In an example, the contact interface can be configured to accept a force to allow the user to move the needle sorter 120 such as with respect to the storage tube 110.

In an example, the user can grasp the knob 252 and apply a force to cause the needle sorter 120 to move relative to the storage tube 110. In an example, the user can engage the bottom surface 241 of the bottom cap 240, such as with a finger or tool through the opening in the bottom end portion 214, such as to apply a pushing force such as to cause the needle sorter 120 to displace relative to the storage tube 110.

At 606, a retaining stop 260 can be provided. In an example, the retaining stop 260 can be configured to interfere or otherwise interact with the top end portion 212 or the inner lip 213 of the storage tube 110, such as to restrict motion of the needle sorter component 120 with respect to the storage container 110. In an example, the retaining stop 260 can be configured to control the size of the access gap 370, such as by adjustment of the retaining stop 260 to a desired one of different locations along the central axis 229 of the needle sorter 120.

At 608, an opening can be provided. In an example, the opening can be created by movement of the needle sorter 120 with respect to the storage tube 110. In an example, the opening can be the access gap 370.

The opening can allow a user convenient access to a portion of any needles stored within the needle spaces 228. In an example, needles stored within the needle spaces 228 can 'feather' or otherwise extend beyond the top of the top end portion 212 of the needle storage tube 110. For example, needles can feather by falling against the top end portion 212 of the storage tube 110, such as shown in FIG. 5. In an example, the user can conveniently select or extract a particular needle from the storage device 100 such as by grasping one of the needles so feathered.

Various Notes & Examples

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A storage device for holding at least one double ended knitting needle, the storage device comprising:
   - a needle sorter including a first end and a second end;
   - a bottom cap including a top surface and a bottom surface, the bottom cap located at the second end of the needle sorter;
   - a storage tube including a top end portion with an inner lip and a bottom end portion, wherein the needle sorter is located within the storage tube, wherein the needle sorter and storage tube define a plurality of needle compartments within the storage tube, and wherein the needle sorter slides with respect to the storage tube to allow user removal of needles from the needle compartments;
   - a gauge cap including a top surface and a bottom surface, the gauge cap located at the first end of the needle sorter, wherein the gauge cap includes a plurality of openings that are located to accept different needle sizes into the needle compartments; and
   - an elastic band located on the needle sorter, wherein the location of the elastic band is user-adjustable to any location along the length of the needle sorter between the bottom surface of the gauge cap and the top surface of the bottom cap, and wherein the elastic band interferes with the inner lip of the top end portion to restrict sliding motion of the needle sorter with respect to the storage tube.

2. The storage device of claim 1, wherein the elastic band is affixed to the needle sorter.

3. The storage device of claim 1, comprising a user-removable lid at the top end portion of the storage tube and a base affixed to the bottom end portion of the storage tube.

4. The storage device of claim 1, wherein the needle sorter includes a longitudinal central axis and a plurality of radial fins extending from the central axis to define separate compartments within the storage tube when the needle sorter is located within the storage tube; and
   - wherein the bottom cap is affixed at the second end of the needle sorter to define a radially extending surface to permit needles to be carried along with the needle sorter when the needle sorter slides with respect to the storage tube.

5. The storage device of claim 3, wherein the lid is attached to the gauge cap to form a single component, the single component configured to provide a plurality of openings to accept different needle sizes into the plurality of needle compartments and removably attach to the top end portion of the storage tube.

6. The storage device of claim 1, comprising an opening, located in the bottom end portion of the storage tube, wherein a bottom surface of the bottom cap is accessible through the opening in the bottom end portion of the storage tube to receive a force sufficient to move the needle sorter with respect to the storage tube.

7. The storage device of claim 1, comprising a guide including a recess, located on an inner surface of the storage tube, and a protuberance, attached to the needle sorter and located within the recess, the guide configured to direct sliding motion of the needle sorter with respect to the storage tube.

8. The storage device of claim 7, wherein the recess located on an inner surface of the storage tube includes a recess with at least one of a linear path, a helical path, or a step-wise continuous path.

9. The storage device of claim 8, wherein the recess located on an inner surface of the storage tube includes a recess with a linear path.

10. The storage device of claim 8, wherein the recess located on an inner surface of the storage tube includes a recess with a helical path.

11. The storage device of claim 8, wherein the recess located on an inner surface of the storage tube includes a recess with a step-wise continuous path.

12. A storage device for holding at least one double ended knitting needle, the storage device comprising:

a needle sorter including a first end and a second end, the needle sorter including a longitudinal central axis and a plurality of radial fins extending from the central axis to define separate needle compartments within a storage tube when the needle sorter is located within the storage tube;

a bottom cap including a top surface and a bottom surface, the bottom cap located at the second end of the needle sorter, the bottom cap being affixed at the second end of the needle sorter to provide a radially extending surface to permit needles to be carried along with the needle sorter;

a storage tube including a top end portion with an inner lip and a bottom end portion with an opening extending from an outer surface of the bottom end portion of the storage tube to an inner surface of the bottom end portion of the storage tube, wherein the needle sorter is located within the storage tube to define a plurality of needle compartments within the storage tube, and wherein the needle sorter slides with respect to the storage tube to allow user removal of needles from the needle compartments;

a gauge cap including a top surface and a bottom surface, the gauge cap located at the first end of the needle sorter, wherein the gauge cap includes a plurality of openings that are located to accept different needle sizes into the needle compartments; and an elastic band a located on the needle sorter and arranged to interfere with the inner lip of the top end portion to restrict sliding of the needle sorter with respect to the storage tube, wherein the bottom surface of the bottom cap is accessible through the opening in the bottom end portion of the storage tube to receive a force sufficient to move the needle sorter with respect to the storage tube.

13. The storage device of claim 12, comprising a guide including a recess, located on an inner surface of the storage tube, and a protuberance, attached to the needle sorter and located within the recess, the guide configured to control sliding motion of the needle sorter with respect to the storage tube.

14. The storage device of claim 13, wherein the recess located on an inner surface of the storage tube includes a recess with at least one of a linear path, a helical path, or a step-wise continuous path.

15. The storage device of claim 14, wherein the recess located on an inner surface of the storage tube includes a recess with a helical path.

16. The storage device of claim 14, wherein the recess located on an inner surface of the storage tube includes a recess with a step-wise continuous path.

17. The storage device of claim 12, wherein the elastic band is user-adjustable to any location along the length of the needle sorter between the bottom surface of the gauge cap and the top surface of the bottom cap so that the retaining stop interferes with the inner lip of the top end portion to restrict sliding of the needle sorter with respect to the storage tube.

18. The storage device of claim 12, wherein the elastic band is affixed to the needle sorter.

19. The storage device of claim 12, comprising a user-removable lid at the top end portion of the storage tube and a base affixed to the bottom end portion of the storage tube.

20. The storage device of claim 14, wherein the recess located on an inner surface of the storage tube includes a recess with a linear path.

* * * * *